US009395678B2

(12) United States Patent
Karasawa et al.

(10) Patent No.: US 9,395,678 B2
(45) Date of Patent: Jul. 19, 2016

(54) WASTE TONER CONTAINER AND IMAGE FORMING APPARATUS

(71) Applicants: Shinya Karasawa, Kanagawa (JP); Hiromichi Ninomiya, Kanagawa (JP); Takeshi Kojima, Kanagawa (JP); Hajime Teraji, Kanagawa (JP); Michiya Okamoto, Kanagawa (JP); Takuma Iwasaki, Tokyo (JP); Daisuke Sawada, Kanagawa (JP); Kentaroh Nodera, Kanagawa (JP); Daisuke Tomita, Kanagawa (JP); Masanori Moro, Kanagawa (JP)

(72) Inventors: Shinya Karasawa, Kanagawa (JP); Hiromichi Ninomiya, Kanagawa (JP); Takeshi Kojima, Kanagawa (JP); Hajime Teraji, Kanagawa (JP); Michiya Okamoto, Kanagawa (JP); Takuma Iwasaki, Tokyo (JP); Daisuke Sawada, Kanagawa (JP); Kentaroh Nodera, Kanagawa (JP); Daisuke Tomita, Kanagawa (JP); Masanori Moro, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/633,378

(22) Filed: Feb. 27, 2015

(65) Prior Publication Data

US 2015/0261172 A1 Sep. 17, 2015

(30) Foreign Application Priority Data

Mar. 11, 2014 (JP) ..... 2014-047097
May 1, 2014 (JP) ..... 2014-094420

(51) Int. Cl.
*G03G 21/10* (2006.01)
*G03G 21/12* (2006.01)

(52) U.S. Cl.
CPC ..... *G03G 21/12* (2013.01)

(58) Field of Classification Search
CPC ..... G03G 21/12
See application file for complete search history.

(56) References Cited

U.S. PATENT DOCUMENTS

| | | | | |
|---|---|---|---|---|
| 2006/0039710 | A1* | 2/2006 | Tawada | G03G 21/105 399/35 |
| 2008/0226333 | A1 | 9/2008 | Ono et al. | |
| 2010/0074665 | A1 | 3/2010 | Okamoto et al. | |
| 2010/0080600 | A1 | 4/2010 | Okamoto et al. | |
| 2011/0052225 | A1 | 3/2011 | Honjoh et al. | |
| 2011/0091227 | A1 | 4/2011 | Tomita et al. | |
| 2011/0097124 | A1 | 4/2011 | Koike et al. | |
| 2011/0206432 | A1 | 8/2011 | Ninomiya et al. | |
| 2012/0014728 | A1 | 1/2012 | Karasawa et al. | |

(Continued)

FOREIGN PATENT DOCUMENTS

| | | |
|---|---|---|
| JP | 2008-233374 | 10/2008 |
| JP | 4621470 | 11/2010 |

(Continued)

*Primary Examiner* — David Gray
*Assistant Examiner* — Michael Harrison
(74) *Attorney, Agent, or Firm* — Harness, Dickey & Pierce, PLC

(57) ABSTRACT

The waste toner container includes: a waste toner detection unit configured to detect a state in which a toner surface of waste toner at that position is displaced up to a ceiling portion or near the ceiling portion. The waste toner detection unit includes: a flexibility member installed so as to cover an opening portion formed in the ceiling portion or a side wall and is configured to be deformed by a direct or indirect push by the waste toner; and a movable member formed so as to contact the flexibility member from outside of the container and so as to be displaced by the direct or indirect push by the waste toner interposing the flexibility member such that displacement thereof is detected by a detection unit. The displacement of the movable member is limited by a regulating member.

20 Claims, 8 Drawing Sheets

(56) References Cited

U.S. PATENT DOCUMENTS

| | | | |
|---|---|---|---|
| 2012/0237230 | A1 | 9/2012 | Karasawa et al. |
| 2013/0243444 | A1 | 9/2013 | Karasawa et al. |

FOREIGN PATENT DOCUMENTS

| | | |
|---|---|---|
| JP | 2012-145670 | 8/2012 |
| JP | 2012-208461 | 10/2012 |

* cited by examiner

WASTE TONER CONTAINER AND IMAGE FORMING APPARATUS

CROSS-REFERENCE TO RELATED APPLICATIONS

The present application claims priority to and incorporates by reference the entire contents of Japanese Patent Application No. 2014-047097 filed in Japan on Mar. 11, 2014 and Japanese Patent Application No. 2014-094420 filed in Japan on May 1, 2014.

BACKGROUND OF THE INVENTION

1. Field of the Invention

The present invention relates to a waste toner container and an image forming apparatus.

2. Description of the Related Art

Conventionally, in an image forming apparatus such as a copier and a printer, there has been known a technique of removing untransferred toner, which remains on an image bearer such as a photoconductor drum, a photoconductor belt, an intermediate transfer belt, and an intermediate transfer drum after a transfer process has been performed, by a cleaning unit, discharging the untransferred toner recovered in the cleaning unit as waste toner from the cleaning unit, and recovering the waste toner in a waste toner container (see, for example, Japanese Granted Patent Publication NO. 4621470 and Japanese Laid-open Patent Application No. 2012-208461).

When a state in which the waste toner container is full (or near-full) with the recovered waste toner is detected by a waste toner detection unit, the container is taken out of an image forming apparatus main body and is replaced with an empty container (maintenance work).

Specifically, in Japanese Granted Patent Publication NO. 4621470, Japanese Laid-open Patent Application No. 2012-208461, and the like, the waste toner detection unit installed in the waste toner container is constituted of a flexibility seal (flexibility member), which is installed so as to cover an opening portion formed in a ceiling portion of the waste toner container, and a movable piece (movable member) contacting the flexibility seal from outside of the waste toner container. Then, when the waste toner container becomes full or near full with the waste toner recovered therein, the movable piece is displaced upward due to a push by the waste toner or a conveyance member through the flexibility seal. A full state or a near-full state of the waste toner in the waste toner container is recognized by a sensor (detection means), which is fixedly installed in the image forming apparatus main body, as it detects the movable piece.

The waste toner container described above in Japanese Granted Patent Publication NO. 4621470, Japanese Laid-open Patent Application No. 2012-208461, and the like has a possibility that a failure may be caused, when it is attached to and detached from the image forming apparatus main body, by the movable member (movable piece) of the waste toner detection unit being displaced upward by some chance, contacting and damaging the image forming apparatus main body.

This has been a problem that cannot be ignored particularly in a case where an opening/closing member for opening/closing an inflow port of the waste toner in link with attaching/detaching operation to and from the image forming apparatus main body is provided such that the waste toner does not leak from the waste toner container when it is attached to and detached from the image forming apparatus main body, in a case where the waste toner container is formed of a relatively soft resin material to decrease weight of the waste toner container, and the like, because during the attaching/detaching operation to and from the image forming apparatus main body, the waste toner container is slightly crushed due to gripping force of an operator, whereby inner pressure inside of the container is in an increased state, and the movable member is lifted upward together with the flexibility member (flexibility seal) due to the increased inner pressure.

Therefore, it is desirable to provide a waste toner container and an image forming apparatus in which, when the waste toner container is attached to and detached from the image forming apparatus main body, the failure that the movable member of the waste toner detection unit is displaced and contacts the image forming apparatus main body is not caused.

SUMMARY OF THE INVENTION

It is an object of the present invention to at least partially solve the problems in the conventional technology.

According to an aspect of the present invention, there is provided A waste toner container installed in an image forming apparatus main body, the waste toner container including: a waste toner detection unit configured to detect a state in which a toner surface of the waste toner at that position is displaced up to a ceiling portion or near the ceiling portion, wherein the waste toner detection unit includes: a flexibility member installed so as to cover an opening portion formed in the ceiling portion or a side wall and is configured to be deformed by a direct or indirect push by the waste toner; and a movable member formed so as to contact the flexibility member from outside of the container and so as to be displaced by the direct or indirect push by the waste toner interposing the flexibility member such that displacement thereof is detected by a detection unit, wherein the displacement of the movable member is limited by a regulating member.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 8A is a side view, FIG. 8B is a back view, and FIG. 8C is a sectional view;

DETAILED DESCRIPTION OF THE PREFERRED EMBODIMENTS

Figure 1:
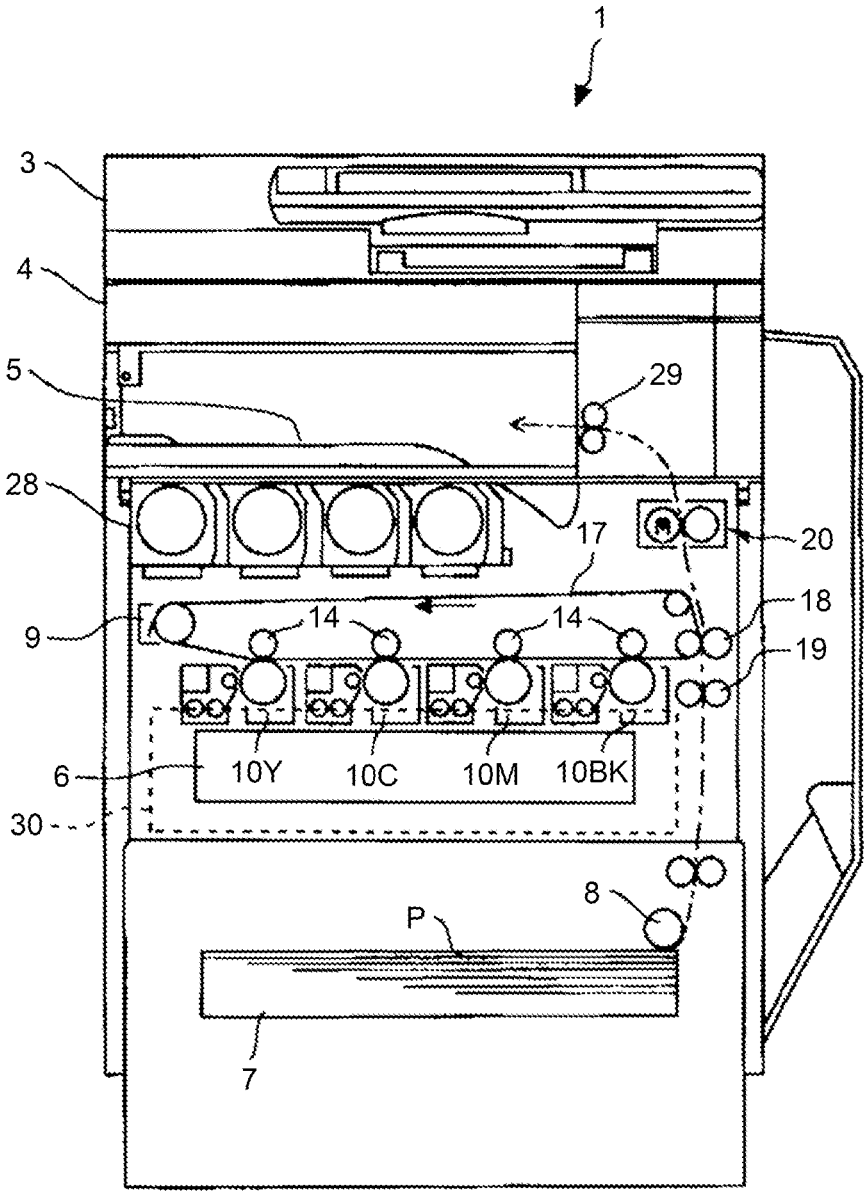
FIG. 1 is an overall configuration view illustrating an image forming apparatus according to a first embodiment of the present invention.

Hereinafter, embodiments for carrying out the present invention are described in detail with reference to the drawings. In the drawings, parts that are the same or equivalent are denoted with the same reference numeral, and a duplicated description is simplified or omitted as appropriate.

First Embodiment

A first embodiment of the present invention is described in detail in FIGS. 1 to 9D.

First, a configuration and operation of an overall image forming apparatus are described in FIG. 1.

An image forming apparatus 1 according to the first embodiment is a tandem color image forming apparatus in which process cartridges 10Y, 10M, 10C, and 10BK as a plurality of image formation units are installed in parallel so as to face an intermediate transfer belt 17 as an intermediate transfer body.

In FIG. 1, a color copier as an image forming apparatus is denoted by 1, an original conveyance unit that conveys an original to an original reading unit 4 is denoted by 3, an original reading unit that reads image information of the original is denoted by 4, a writing unit (exposure unit) that emits a laser beam based the input image information is denoted by 6, a feeder unit in which a recording medium P such as transfer paper is stored is denoted by 7, process cartridges as the image formation units corresponding to each of colors (yellow, magenta, cyan, and black) are denoted by 10Y, 10M, 10C, and 10BK, an intermediate transfer belt (image bearer) on which a toner image of multiple colors is overlapped and transferred is denoted by 17, a secondary transfer roller that transfers the toner image formed on the intermediate transfer belt 17 to the recording medium P is denoted by 18, a fixing unit that fixes an unfixed image on the recording medium P is denoted by 20, a toner container for supplying toner of each of the colors to a developing device of each of the process cartridges 10Y, 10M, 10C, and 10BK is denoted by 28, and a waste toner container in which waste toner is recovered is denoted by 30.

Figure 2:
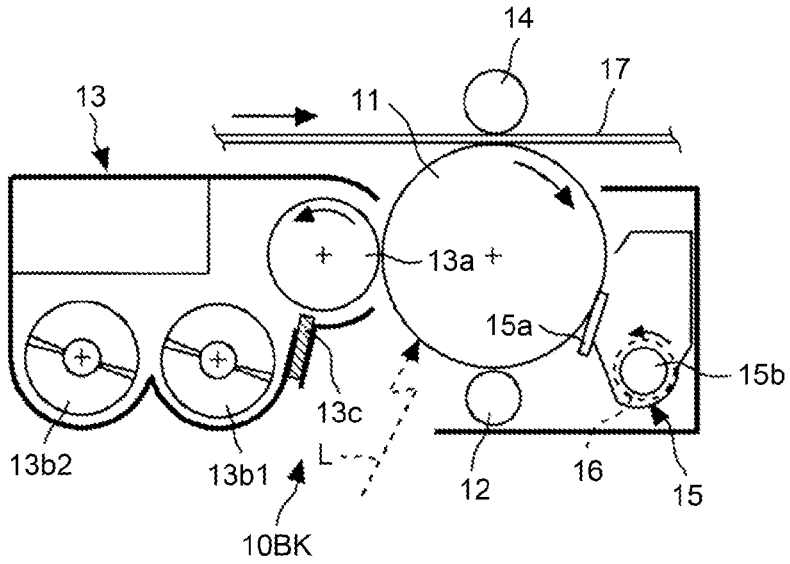
FIG. 2 is a configuration diagram illustrating an image formation unit.

Here, each of the process cartridges 10Y, 10M, 10C, and 10BK (image formation units) is an integrated unit of a photoconductor drum 11 as the image bearer, a charging unit 12, a developing unit 13 (developing device), and a cleaning unit 15 (cleaning device) (see FIG. 2). Each of the process cartridges 10Y, 10M, 10C, and 10BK is replaced with a new one when it reaches an end of its life.

On the photoconductor drum 11 (image bearer) of each of the process cartridges 10Y, 10M, 10C, and 10BK, the toner image of each of the colors (yellow, magenta, cyan, and black) is formed.

Hereinafter, operation of forming a normal color image by the image forming apparatus is described.

First, an original is conveyed from an original table by a conveyance roller of the original conveyance unit 3 and is placed on a contact glass of the original reading unit 4. Then, image information of the original that has been placed on the contact glass is optically read by the original reading unit 4.

Specifically, the original reading unit 4 irradiates and scans an image of the original on the contact glass with light emitted from an illumination lamp. Then, the light reflected by the original is image-formed on a color sensor through a mirror group and a lens. The color image information of the original is read for each of color-separated light of RGB (red, green, and blue) by the color sensor and is converted into an electric image signal. Furthermore, based on the RGB color-separated image signal, processing such as color conversion processing, color correction processing, and spatial frequency correction processing is performed by an image processing unit (not illustrated), whereby the color image information of yellow, magenta, cyan, and black is obtained.

Then, the image information of each of the colors of yellow, magenta, cyan, and black is transmitted to the writing unit 6. Then, the writing unit 6 emits a laser beam (exposure light) based on the image information of each of the colors toward the photoconductor drum 11 of the corresponding process cartridges 10Y, 10M, 10C, and 10BK.

On the other hand, each of the four photoconductor drums 11 is rotated in a clockwise direction as illustrated in the drawing. With reference to FIG. 2, firstly, a surface of the photoconductor drum 11 is uniformly charged at a position facing the charging unit 12 (charging roller) (charging process). In this way, charging potential is formed on the photoconductor drum 11 as the image bearer. Subsequently, the charged surface of the photoconductor drum 11 reaches a radiation position of each of the laser beams.

The writing unit 6 emits the laser beam corresponding to the image signal from a light source corresponding to each of the colors. Although illustration is omitted, the laser beam enters a polygon mirror and is reflected thereby, and transmits through a plurality of lenses. The laser beam that has transmitted through the plurality of lenses passes through a different optical path for each of color components of yellow, magenta, cyan, and black (exposure process).

The surface of the photoconductor drum 11 of the process cartridge 10Y, which is the first process cartridge from the left in the drawing, is irradiated with the laser beam corresponding to the yellow component. At this time, the surface is scanned with the laser beam of the yellow component in a rotation shaft direction (main-scanning direction) of the photoconductor drum 11 by a polygon mirror (not illustrated), which rotates at a high speed. In this way, an electrostatic latent image corresponding to the yellow component is formed on the photoconductor drum 11, which has been charged by the charging unit 12.

Similarly, the surface of the photoconductor drum 11 of the process cartridge 10C, which is the second process cartridge from the left in the drawing, is irradiate with the laser beam of the cyan component, whereby an electrostatic latent image of the cyan component is formed. The surface of the photoconductor drum 11 of the process cartridge 10M, which is the third process cartridge from the left in the drawing, is irradiated with the laser beam corresponding to the magenta component, whereby an electrostatic latent image corresponding to the magenta component is formed. The surface of the photoconductor drum 11 of the process cartridge 10BK (image formation unit for black color), which is the fourth process cartridge from the left in the drawing (on the most downstream side in a travelling direction of the intermediate transfer belt 17), is irradiated with the laser beam of the black component, whereby the electrostatic latent image of the black component is formed.

Subsequently, the surface of the photoconductor drum 11, on which the electrostatic latent image of each of the colors is formed, reaches a position facing the developing unit 13 (see FIG. 2). Then, the photoconductor drum 11 is supplied with the toner of each of the colors from each of the developing units 13, whereby the latent image on the photoconductor drum 11 is developed (development process).

Subsequently, the surface of the photoconductor drum 11 after the development process reaches a position facing the intermediate transfer belt 17 (intermediate transfer body) as the image bearer. Here, at each of the facing positions, a primary transfer roller 14 is installed so as to abut on an inner peripheral surface of the intermediate transfer belt 17 as the intermediate transfer body. Then, at a position of the primary transfer roller 14, on the intermediate transfer belt 17 as the image bearer, the toner image of each of the colors formed on the photoconductor drum 11 is transferred in order in an overlapping manner (first transfer process).

Then, the surface of the photoconductor drum 11 after the first transfer process reaches a position facing the cleaning unit 15 (see FIG. 2). Then, untransferred toner remaining on the photoconductor drum 11 (image bearer) is recovered by the cleaning unit 15 (cleaning process).

Subsequently, the surface of the photoconductor drum 11 passes a position of a destaticizing unit (not illustrated), whereby a series of image forming processes by the photoconductor drum 11 is completed.

On the other hand, a surface of the intermediate transfer belt 17, on which the image of each of the colors on the photoconductor drum 11 has been transferred in the overlapping manner, travels in a direction of an arrow in the drawing and reaches a position of the secondary transfer roller 18. Then, at the position of the secondary transfer roller 18, the full-color image on the intermediate transfer belt 17 is secondary transferred on the recording medium P (second transfer process).

Subsequently, the surface of the intermediate transfer belt 17 reaches a position of an intermediate transfer belt cleaning unit 9 (cleaning unit). Then, untransferred toner on the intermediate transfer belt 17 as the image bearer is recovered by the intermediate transfer belt cleaning unit 9 (cleaning unit), whereby a series of transfer processes on the intermediate transfer belt 17 is completed.

Here, the recording medium P at the position of the secondary transfer roller 18 has been conveyed from the feeder unit 7 via a conveyance guide, a registration roller 19, and the like.

Specifically, the recording medium paper P fed from the feeder unit 7 storing the recording medium P by a paper feeding roller 8 is guided to the registration roller 19 after passing the conveyance guide. The recording medium P that has reached the registration roller 19 is conveyed toward the position of the secondary transfer roller 18 at the same timing as the toner image on the intermediate transfer belt 17.

Subsequently, the recording medium P on which the full-color image has been transferred is guided to a fixing unit 20. At the fixing unit 20, at a nip between a fixing roller and a pressurizing roller, the color image is fixed on the recording medium P.

Then, the recording medium P after a fixing process is discharged as an output image by a paper ejection roller 29 to outside of an apparatus main body 1 and is stuck on a paper ejection unit 5, whereby a series of image forming processes is completed.

Next, the image formation unit of the image forming apparatus is described in detail in FIG. 2.

FIG. 2 is a configuration diagram illustrating the process cartridge 10BK for the black color. Each of the other three process cartridges 10Y, 10M, and 10C is configured substantially the same as the process cartridge 10BK for the black color except that color of the toner used in the image forming process is different, whereby illustration and description thereof are omitted.

As illustrated in FIG. 2, in the process cartridge 10BK, the photoconductor drum 11 as the image bearer, the charging unit 12 that charges the photoconductor drum 11, the developing unit 13 that develops the electrostatic latent image formed on the photoconductor drum 11, and the cleaning unit 15 that recovers untransferred toner on the photoconductor drum 11 are integrally stored in a case.

Here, the photoconductor drum 11 as the image bearer is a negative-charged organic photoconductor in which a photoconductor layer and the like are provided on a drum-shaped conductive support. Although illustration is omitted, in the photoconductor drum 11, an undercoating layer, which is an insulation layer, and a charge generating layer as a photoconductor layer, a charge transport layer, and a protective layer (surface layer) are layered in order on the conductive support as a base layer.

The charging unit 12 is a charging roller in which a middle resistance elastic layer covers an outer periphery of a conductive cored bar. Then, a predetermined voltage is applied to the charging unit 12 (charging roller) from an unillustrated power supply unit, whereby the surface of the facing photoconductor drum 11 is uniformly charged.

The developing unit 13 (developing device) is mainly constituted of a developing roller 13*a* facing the photoconductor drum 11, a first conveyance screw 13*b*1 facing the developing roller 13*a*, a second conveyance screw 13*b*2 facing the first conveyance screw 13*b*1 interposing a partition member, and a doctor blade 13*c* facing the developing roller 13*a*. The developing roller 13*a* is constituted of a magnet, which is fixedly installed thereinside and forms a magnetic pole on a peripheral surface of the roller, and a sleeve, which rotates around the magnet. A plurality of magnetic poles is formed on the developing roller 13*a* (sleeve) by the magnet, whereby developer is born on the developing roller 13*a*.

A two-component developer constituted of a carrier and toner is housed inside the developing unit 13. In the first embodiment, a toner having a small particle diameter and a substantially spherical shape is used for improving image quality.

Specifically, the toner is formed so as to have circularity of 0.92 or greater. The "circularity" is an average circularity measured by a flow type particle image analyzer "FPIA-2000" (Sysmex Corporation). Specifically, 0.1 to 0.5 ml of a surfactant (preferably, alkylbenzenesulfonic acid salt) is added as a dispersant to 100 to 150 ml of water, from which solid impurities are removed in advance, in a container, and 0.1 to 0.5 g of a measuring sample (toner) is further added thereto. Subsequently, a suspension in which the toner has been dispersed is dispersion processed in an ultrasonic disperser for about one to three minutes such that concentration of dispersion liquid is 3000 to 10000/μl. The dispersion liquid is set in the above-described analyzer, whereby a shape and distribution of the toner are measured.

The toner is formed such that each of shape coefficients SF-1 and SF-2 is in a range of 100 to 180.

The toner is also formed such that a volume average particle size (Dv) is in a range of 3 to 8 μm and a ratio of the volume average particle size (Dv) to a number average particle diameter (Dn) (Dv/Dn) is in a range of 1.05 to 1.40.

Furthermore, the toner is formed such that a ratio of a major axis to a minor axis (r1/r2) is in a range of 0.5 to 1.0 and a ratio of thickness to the minor axis (r3/r2) is in a range of 0.7 to 1.0, whereby a relationship of the major axis r1≥minor axis r2≥thickness r3 is satisfied.

This toner having the small particle diameter and the spherical shape can be manufactured by causing cross-linking reaction and/or extension reaction of a toner composite, which contains polyester prepolymer having a functional group including a nitrogen atom, polyester, a colorant, and a release agent, in an aqueous medium in a state where a resin fine particle exists.

With reference to FIG. 2, in the cleaning unit 15 (cleaning device), a cleaning blade 15*a* that abuts on the photoconductor drum 11, a conveyance coil 15*b* (conveyance pipe 16) that conveys the untransferred toner recovered as the waste toner in the cleaning unit 15 toward the waste toner container 30 (see FIG. 3), and the like are installed. The cleaning blade 15*a* is constituted of a rubber material such as a urethane rubber and abuts on the surface of the photoconductor drum 11 at a predetermined angle and a predetermined pressure. Accordingly, an attached substance such as the untransferred toner attached to the photoconductor drum 11 is mechanically scraped off and is recovered in the cleaning unit 15. Then, the untransferred toner recovered in the cleaning unit 15 is conveyed to the waste toner container 30 through the conveyance pipe 16 as a conveyance unit (the conveyance coil 15*b* is installed inside) and is recovered as the waste toner inside the waste toner container 30.

Similarly, with reference to FIG. 1, also in the intermediate transfer belt cleaning unit 9 as the cleaning unit, a cleaning blade that abuts on the intermediate transfer belt 17 (intermediate transfer body), a conveyance coil (conveyance pipe 16) that conveys the untransferred toner, which has been recovered in the intermediate transfer belt cleaning unit 9, as the waste toner toward the waste toner container 30 (see FIG. 3), and the like are installed. Then, the untransferred toner recovered in the intermediate transfer belt cleaning unit 9 is conveyed to the waste toner container 30 through the conveyance pipe 16 as the conveyance unit (conveyance coil is installed inside) and is recovered as the waste toner inside the waste toner container 30. Note that a configuration and operation of the waste toner container 30 are described in detail below.

Note that the attached substance that attaches to the photoconductor drum 11 and the intermediate transfer belt 17 includes paper powder generated from the recording medium P (paper), a discharge product generated on the photoconductor drum 11 during discharging by the charging unit 12 (charging roller), an additive added to the toner, and the like in addition to the untransferred toner, whereby these are generally referred to as the "untransferred toner" in the present application.

In FIG. 2, the above-described image forming process is elaborated in detail.

The developing roller 13*a* is rotated in the direction of the arrow (counterclockwise direction) in FIG. 2. The developer inside the developing unit 13 is circulated in a longitudinal direction while being stirred and mixed with the toner, which is supplied from the toner container 28 by an unillustrated toner supply unit by rotation of the first conveyance screw 13*b*1 and the second conveyance screw 13*b*2, which are arranged so as to interpose the partition member therebetween (vertical direction of the drawing in FIG. 2).

Then, the toner that has adsorbed to the carrier by friction charging is born on the developing roller 13*a* with the carrier. The developer born on the developing roller 13*a* subsequently reaches a position of the doctor blade 13*c*. Then, the developer on the developing roller 13*a* is adjusted to an appropriate amount at the position of the doctor blade 13*c* and reaches a position facing the photoconductor drum 11 (in a development area).

Subsequently, in the development area, the toner within the developer attaches to the electrostatic latent image formed on the surface of the photoconductor drum 11. Specifically, the toner attaches to the latent image (the toner image is formed) due to an electric field formed by a potential difference (developing potential) between a latent image potential (exposure potential) of an image portion, which has been irradiated with a laser beam L, and a developing bias applied to the developing roller 13*a*.

Subsequently, most of the toner that has attached to the photoconductor drum 11 during a developing process is transferred to the intermediate transfer belt 17. Then, the untransferred toner remaining on the photoconductor drum 11 is recovered in the cleaning unit 15 by the cleaning blade 15*a*.

Here, although illustration is omitted, the toner supply unit provided in the apparatus main body 1 is constituted of the bottle-shaped toner container 28 configured to be replaceable, and a toner hopper unit that holds and rotary drives the toner container 28 as well as supplies new toner to the developing unit 13. The new toner (any of yellow, magenta, cyan, and black) is housed inside the toner container 28. A helical projection is formed on an inner peripheral surface of the toner container 28 (toner bottle).

Note that the new toner inside the toner container 28 is supplied from a toner supply port to inside the developing unit 13 as appropriate as the toner inside the developing unit 13 (existing toner) is consumed. Although illustration is omitted, consumption of the toner inside the developing unit 13 is indirectly or directly detected by a reflection type photosensor facing the photoconductor drum 11 and by a magnetometric sensor installed below the second conveyance screw 13*b*2 of the developing unit 13.

Hereinafter, by using FIGS. 3 to 8C, a configuration and operation characteristic of the waste toner container 30 of the first embodiment is described in detail.

Figure 3:
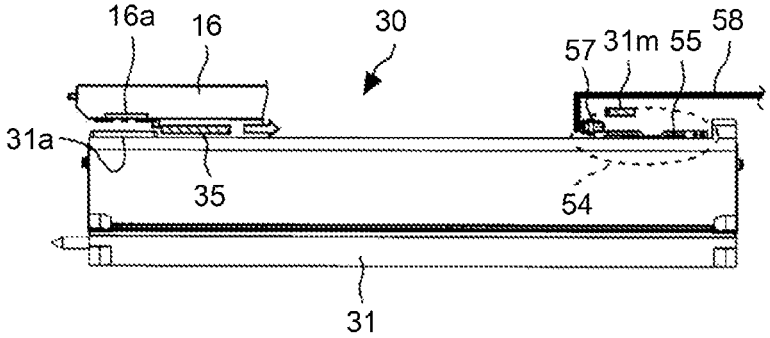
FIG. 3 is an external view illustrating a waste toner container in a state of being connected to a conveyance unit in a depth direction.
Figure 4:
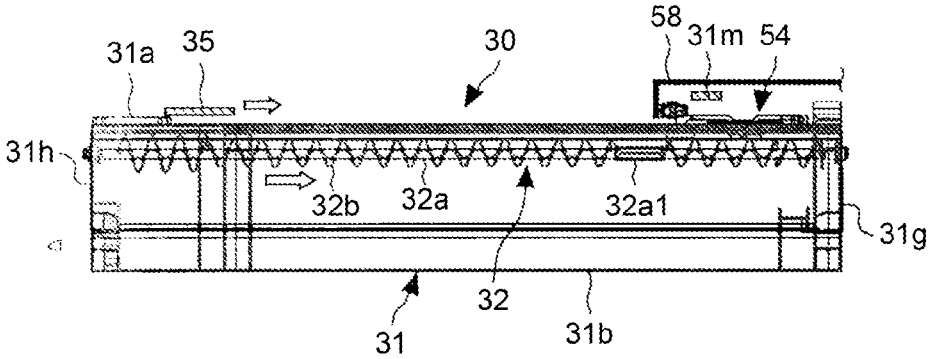
FIG. 4 is a view illustrating inside of the waste toner container projected in the depth direction.
Figure 5:
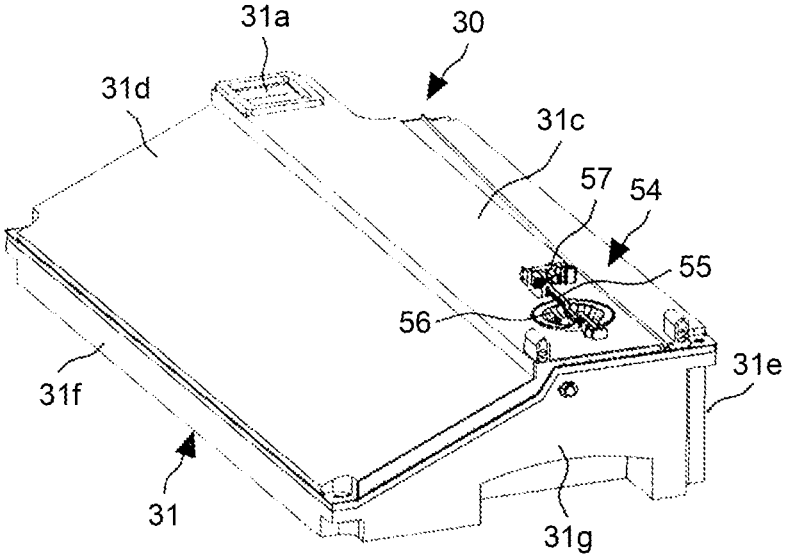
FIG. 5 is a perspective view illustrating the waste toner container.
Figure 6:
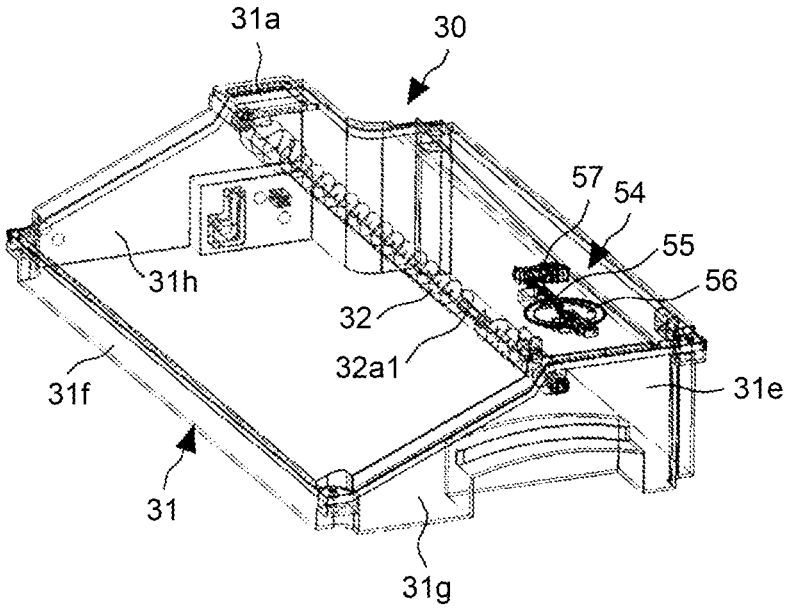
FIG. 6 is a perspective view illustrating inside of the waste toner container in a projected manner.

Note that FIGS. 3 to 8C are views illustrating the waste toner container 30 in a state (posture) of being installed in the image forming apparatus main body 1. In FIGS. 5 and 6, illustration of a shutter 35 and a bracket 58 is omitted to facilitate understanding. FIGS. 3 and 4 are views of the waste toner container 30 viewed from a front side (side of a tip wall portion 31*f*), and FIGS. 7A to 7C are views thereof viewed from a rear side (side of a vertical wall portion 31*e*).

As described above by using FIGS. 1 and 2, the waste toner container 30 is configured to recover the untransferred toner discharged from the cleaning unit 15, which removes the untransferred toner on each of the photoconductor drums 11 (image bearer) of each of the four process cartridges 10Y, 10M, 10C, and 10BK, and the untransferred toner discharged from the intermediate transfer belt cleaning unit 9, which removes the untransferred toner on the intermediate transfer belt 17 (image bearer), as the waste toner. With reference to FIG. 3, both of the waste toner recovered by the cleaning unit 15 and the intermediate transfer belt cleaning unit 9 are conveyed to the conveyance pipe 16 as the conveyance unit. After being conveyed through the conveyance pipe 16, the waste toner is discharged from a discharge port 16*a* and is flowed into the waste toner container 30 through an inflow port 31*a*.

With reference to FIGS. 3 to 6, the waste toner container 30 is constituted of a container main body 31 (case) in which the inflow port 31*a* is formed, a conveyance screw 32 as a conveyance member, a waste toner detection unit 54 for detecting a full state (or a near-full state), the shutter 35 as an opening/closing member for opening/closing the inflow port 31*a* in link with attaching/detaching operation to and from the image forming apparatus main body 1, and the like.

The inflow port 31*a* is arranged on one end side in a width direction (crosswise direction in FIGS. 3 and 4) of the container main body 31 (waste toner container 30) and on a front side in a depth direction (vertical direction of the drawing in FIGS. 3 and 4), and it is formed so as to open upward. The shutter 35 (opening/closing member) capable of moving in an attaching/detaching direction (crosswise direction in FIGS. 3 and 4) is installed in the inflow port 31*a*. In a state where the waste toner container 30 is not installed in the apparatus main body 1 (state where a force for opening the shutter 35 is not energized), the inflow port 31*a* is closed by the shutter 35, which is energized by a spring (not illustrated). Then, when the waste toner container 30 is installed in the image forming apparatus main body 1, the shutter 35 is engaged with a projected portion formed on a bottom face of the conveyance pipe 16, and the shutter 35 is pushed so as to resist an energizing force of the spring, whereby the inflow port 31*a* is opened. Then, as illustrated in FIG. 3, the inflow port 31*a* is in a state of being communicated into the discharge port 16*a* of the conveyance pipe 16, whereby the waste toner discharged from the cleaning units 9 and 15 is flowed therein.

The conveyance screw 32 as the conveyance member is rotated in a predetermined direction and conveys the waste toner flowed in from the inflow port 31*a* from the one end side in the width direction to the other end side in the width direction (conveyance in a direction of a white arrow in FIG. 4).

Specifically, with reference to FIG. 4, the conveyance screw 32 (conveyance member) is a screw member in which a screw unit 32*b* is wound around a shaft portion 32*a* extending in the width direction, and both end portions thereof in the width direction are rotatably supported by the container main body 31 through bearings.

Furthermore, on one end side of the shaft portion 32*a* of the conveyance screw 32, a gear is installed that meshes with a drive gear (not illustrated) installed in the apparatus main body 1 in a state where the waste toner container 30 is installed in the image forming apparatus main body 1. Then, when a driving force is transmitted from the drive gear to the gear and the conveyance screw 32 is rotary driven in the predetermined direction, the waste toner is conveyed from the one end side in the width direction to the other end side in the width direction by the conveyance screw 32 (conveyance from the left to the right in FIG. 4).

Note that in the conveyance screw 32 of the first embodiment, such that the full state can be detected by the waste toner detection unit 54 in a state where the waste toner is recovered substantially uniformly within the container main body 31, a straight portion 32*a*1 around which the screw unit 32*b* is not wound is formed in the shaft portion 32*a* at a position close to the waste toner detection unit 54.

Note that in the first embodiment, it is configured such that the gear is installed in the one end side of the shaft portion 32*a* of the conveyance screw 32, and the rotary driving force is transmitted by the gear meshing with the drive gear installed in the apparatus main body 1; however, a means for transmitting the rotary driving force from the apparatus main body 1 to the conveyance screw 32 is not limited to this. For example, it is also possible to configure such that a driven coupling is installed in the one end side of the shaft portion 32*a* of the conveyance screw 32, and the rotary driving force is transmitted by the driven coupling fitting with a driving coupling installed in the apparatus main body 1.

The waste toner detection unit 54 is arranged on the other end side in the width direction (right side in FIG. 4) and the front side in the depth direction, and it detects a state in which a toner surface of the waste toner at that position is displaced up to or near a ceiling portion 31*c*.

Figure 7A:
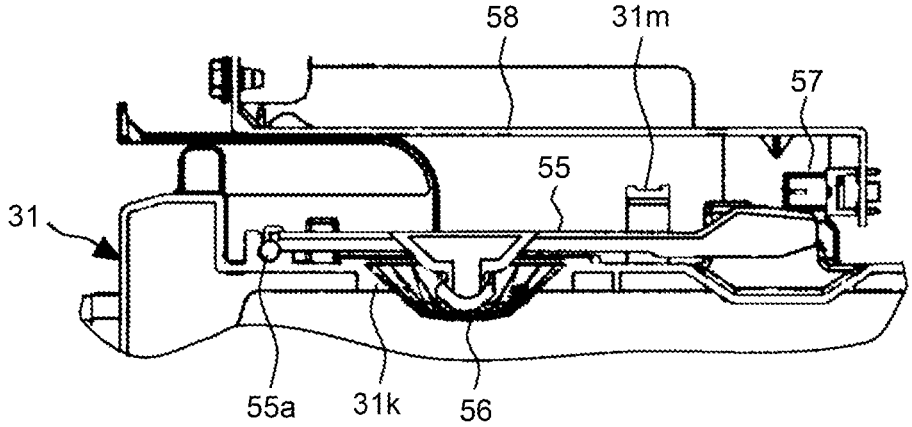
FIGS. 7A to 7C are enlarged sectional views illustrating operation of a movable member of a waste toner detection unit.
Figure 7B:
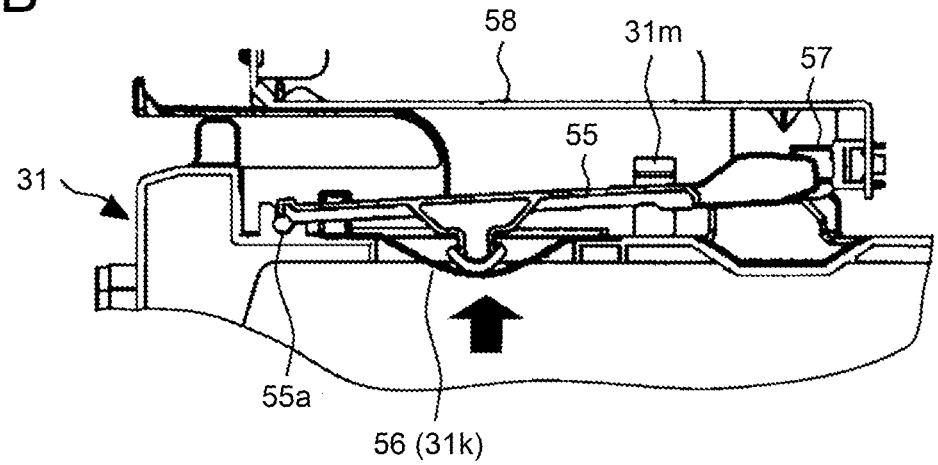
Figure 7C:
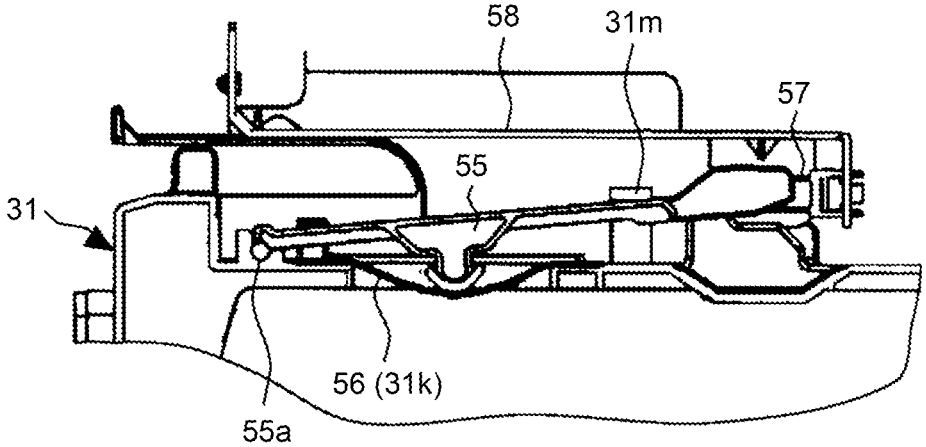

Here, with reference to FIGS. 7A to 7C (or, FIGS. 5, 6, and the like), the waste toner detection unit 54 is constituted of a rubber sheet 56 as a flexibility member, a filler 55 as a movable member, a photosensor 57 as a detection means (optical sensor), and the like. The rubber sheet 56 and the photosensor 57 are installed in the waste toner container 30, and the photosensor 57 is installed in the image forming apparatus main body 1 (bracket 58).

The rubber sheet 56 as the flexibility member is installed (stuck) so as to cover an opening portion 31*k* formed in the waste toner container 30 (container main body 31), and it is formed so as to be deformed by a push by the waste toner deposited at that position. Note that the rubber sheet 56 may be formed of a rubber material having thickness of 0.5 mm or below, for example.

The filler 55 as the movable member is installed so as to contact the rubber sheet 56 from outside of the container main body 31 and is turnably supported by the container main body 31 centering on a spindle 55*a*. Then, the filler 55 is displaced with the rubber sheet 56 by a rise of the toner surface accompanied by an increase of an amount of the waste toner, whereby displacement thereof is detected by the photosensor 57.

Furthermore, the photosensor 57 as the detection means is fixedly installed in the bracket 58 as a holding member formed of stainless steel and the like by a snap lock. The bracket 58 is fixedly installed in a side plate of the image forming apparatus main body 1 by screw fastening.

By the waste toner detection unit 54 configured this way, when the waste toner recovered in the waste toner container 30 (container main body 31) is not in the full state, as illustrated in FIG. 7A, the filler 55 is maintained at a posture that is not detected by the photosensor 57. In contrast, when the waste toner recovered in the waste toner container 30 (container main body 31) is in the full state (or the near-full state), as illustrated in FIG. 7B, the filler 55 is displaced with the rubber sheet 56, whereby it is rotated around to a position detected by the photosensor 57.

Note that the photosensor 57 is mainly constituted of a light emitting element and a light receiving element. The filler 55 is interposed between the light emitting element and the light receiving element, and the posture of the above-described filler 55 is detected by whether the light, which is emitted from the light emitting element and reaches the light receiving element, is blocked or not.

Note that in the first embodiment, the photosensor 57 is not installed on the waste toner container 30 side, but the photosensor 57 is installed on the apparatus main body 1 side, whereby it is possible to reduce the number of components and a cost of the waste toner container 30.

Then, when a state in which the waste toner deposited within the waste toner container 30 (container main body 31) has reached a predetermined amount is detected by the waste toner detection unit 54 (waste toner full detection unit), conveyance of the waste toner to the waste toner container 30 through the conveyance pipe 16 is stopped by a control unit, and the state is informed on a display unit (not illustrated) of the apparatus main body 1. Then, a user (or a service person) who has recognized the state performs replacement and maintenance on the waste toner container 30 that has become full.

Note that the waste toner container 30 can be taken out of the apparatus main body 1 by opening a main body cover (not illustrated) of the apparatus main body 1 and moving it to the right in FIG. 3 (front side of the drawing in FIG. 1). Then, a new (empty) waste toner container 30 is installed in the apparatus main body 1, which is in a state where the main body cover is opened, by moving it to the left in FIG. 3 (back side of the drawing in FIG. 1).

Note that in the first embodiment, it is controlled such that, when the state in which the waste toner deposited in the waste toner container 30 has reached the predetermined amount is detected by the waste toner detection unit 54, conveyance of the waste toner to the waste toner container 30 through the conveyance pipe 16 is stopped by the control unit, and the state (full state) is informed on the display unit of the apparatus main body 1. In contrast, it is also possible to control such that, when the state in which the waste toner deposited in the waste toner container 30 has reached the predetermined amount (near-full state close to the full state) is detected by the waste toner detection unit 54, the state (near-full state) is informed on the display unit of the apparatus main body 1, and after a predetermined number of sheets (or a predetermined number of accumulated pixels) are printed, the conveyance of the waste toner to the waste toner container 30 through the conveyance pipe 16 is stopped by the control unit, and the state (full state) is informed on the display unit of the apparatus main body 1.

Here, with reference to FIG. 5 and the like, the waste toner container 30 of the first embodiment is formed such that a shape viewed from the side is substantially trapezoidal (a trapezoid formed such that a distance from the inflow port 31*a* to the front side in the depth direction is short and a distance from the inflow port 31*a* to the back side in the depth direction is long).

Specifically, a space inside the container main body 31 of the waste toner container 30 is formed of a horizontal bottom portion 31*b* as a bottom portion, the horizontal ceiling portion 31*c* as a ceiling portion, an inclined ceiling portion 31*d*, the vertical wall portion 31*e*, the tip wall portion 31*f*, and side wall portions 31*g* and 31*h*. The container main body 31 is formed to have a fixed thickness that is relatively thin, and it is a substantially airtight container constituted of a resin material and is airtight except for the inflow port 31*a* and the opening portion 31*k*. That is, all of the horizontal bottom portion 31*b*, the horizontal ceiling portion 31*c*, the inclined ceiling portion 31*d*, the vertical wall portion 31*e*, the tip wall portion 31*f*, and the side wall portions 31*g* and 31*h* are formed to have the fixed thickness (of about 1 to 2 mm), and a substantially closed space is formed by these portions 31*b* to 31*h*.

The horizontal bottom portion 31*b* as the bottom portion is formed so as to extend in the depth direction (direction orthogonal to the width direction, or a vertical direction of the drawing in FIG. 4). Specifically, the horizontal bottom portion 31*b* (bottom portion) is formed so as to face the horizontal ceiling portion 31*c* and the inclined ceiling portion 31*d* in the depth direction, and it becomes a substantially horizontal state when the waste toner container 30 is installed in the apparatus main body 1.

The horizontal ceiling portion 31*c* as the ceiling portion is formed so as to cover above the conveyance screw 32 in the width direction and is formed so as to connect to an upper end in an inclination direction of the inclined ceiling portion 31*d*. The horizontal ceiling portion 31*c* is formed so as to be substantially parallel to the horizontal bottom portion 31*b*.

The inclined ceiling portion 31*d* is formed so as to incline downward toward the back side in the depth direction from a side on which the conveyance screw 32 is installed (side of the horizontal ceiling portion 31*c*). The conveyance screw 32 (conveyance member) is arranged at a position close to a border of the horizontal ceiling portion 31*c* and the inclined ceiling portion 31*d*.

The vertical wall portion 31*e* is formed so as to be substantially orthogonal to the horizontal bottom portion 31*b* and the horizontal ceiling portion 31*c* at a position close to the waste toner detection unit 54 on the front side in the depth direction.

The tip wall portion 31*f* is formed to be substantially orthogonal to the horizontal bottom portion 31*b* so as to connect an end portion of the horizontal bottom portion 31*b* and an end portion of the horizontal ceiling portion 31*c* on the back side in the depth direction.

The side wall portions 31*g* and 31*h* are formed to be substantially orthogonal to the horizontal bottom portion 31*b* so as to connect the horizontal bottom portion 31*b* as well as the horizontal ceiling portion 31*c* and the inclined ceiling portion 31*d* at both end portions thereof in the width direction.

Here, with reference to FIGS. 7A to 7C (or, FIGS. 3 and 4), in the waste toner container 30 of the first embodiment, a regulating member 31*m* (regulating unit) that limits displacement of the filler 55 (movable member) is installed. That is, it is configured such that the displacement of the filler 55 (movable member) is limited by the regulating member 31*m*.

Specifically, the regulating member 31*m* is a hook-shaped (reverse L-shaped) projection that is resin molded simultaneously with the container main body 31 as a part of the container main body 31, and it is formed so as to cover above a central portion of the filler 55 (side close to the photosensor 57), which is installed so as to protrude to a position above the ceiling portion (horizontal ceiling portion 31*c*). That is, the regulating member 31*m* is formed so as to limit the displacement of the filler 55 upward exceeding a position of the photosensor 57 (detection means) by contacting the filler 55 (movable member).

Specifically, with reference to FIG. 7C, the filler 55 is not capable of rotating upward (counterclockwise direction) unlimitedly centering on the spindle 55*a*, whereby it is rotated upward with the position where it abuts on the regulating member 31*m* as a limit.

Note that the position where the filler 55 is regulated by the regulating member 31*m* (position in FIG. 7C) is a position where the filler 55 does not contact (interfere with) a constituent member of the bracket 58 and the like of the image forming apparatus main body 1 even if attaching/detaching of the waste toner container 30 to and from the image forming apparatus main body 1 is performed (movement in a crosswise direction in FIGS. 3 and 4), and it is a position where operation of the filler 55 for detecting the full state by the above-described photosensor 57 is not hindered. Specifically, with reference to FIGS. 7A to 7C and the like, the regulating member 31*m* is formed so as to contact the filler 55 between the spindle 55*a* (rotation center position) of the filler 55 (movable member) and a position of the photosensor 57 (detection means) in the attaching/detaching direction of the waste toner container 30 to and from the image forming apparatus main body 1.

Accordingly, when the waste toner container 30 is attached to and detached from the image forming apparatus main body 1, it is possible to securely prevent a failure that the filler 55 is displaced upward by some chance such as in a case where the filler 55 is displaced upward due to vibration when it is forcefully attached to and detached from the waste toner container 30, for example, and contacts the image forming apparatus main body.

In particular, the waste toner container 30 of the first embodiment is provided with the shutter 35 such that the waste toner does not leak out of the container when it is attached to and detached from the image forming apparatus main body 1, and the waste toner container 30 is formed of a relatively soft and thin resin material for decreasing weight, whereby the waste toner container 30 is slightly crushed due to a gripping force of an operator at the central portion of the waste toner container 30, and an inner pressure inside the container becomes an increased state (see a part surrounded by a dashed line in FIGS. 9A to 9D) during the attaching/detaching operation to and from the image forming apparatus main body 1. The filler 55 is easily lifted upward together with the rubber sheet 56 due to the increased inner pressure, whereby it becomes effective to provide the regulating member 31*m* that limits movement (rotation) of the filler 55 upward.

Here, in the first embodiment, it is formed such that the waste toner container 30 is positioned or temporary positioned relative to the image forming apparatus main body 1 at a position close to the photosensor 57 (detection means).

Figure 8A:
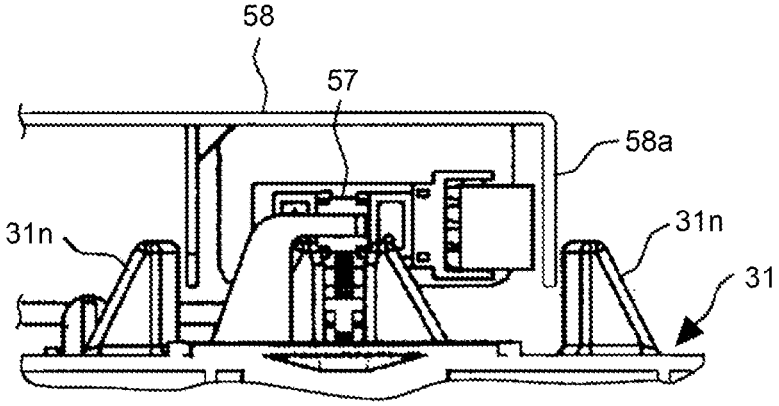
FIGS. 8A to 8C are enlarged views illustrating a state in which an image forming apparatus main body and the waste toner container are positioned or temporary positioned near a detection means.

Specifically, as illustrated in FIG. 8A, in the bracket 58 to which the photosensor 57 is held, a bent portion 58*a* is formed in each of both end portions so as to sandwich the photosensor 57 in a direction orthogonal to the attaching/detaching direction of the waste toner container 30 (vertical direction of the drawing in FIG. 3). Then, when the waste toner container 30 is attached to and detached from the image forming apparatus main body 1, such that it is attached to and detached from being guided by the bent portion 58*a* of the above-described bracket 58, a guide portion 31*n* (illustration thereof is omitted in FIGS. 3 to 7C and the like) standing upward so as to sandwich the bent portion 58*a* is formed in the container main body 31 of the waste toner container 30. Accordingly, the waste toner container 30 is attached to and detached from the image forming apparatus main body 1 without contacting the photosensor 57, and the position thereof relative to the image forming apparatus main body 1 when it is installed is temporarily determined (temporarily positioned), whereby it is possible to improve positional accuracy of the filler 55 relative to the photosensor 57.

Figure 8B:
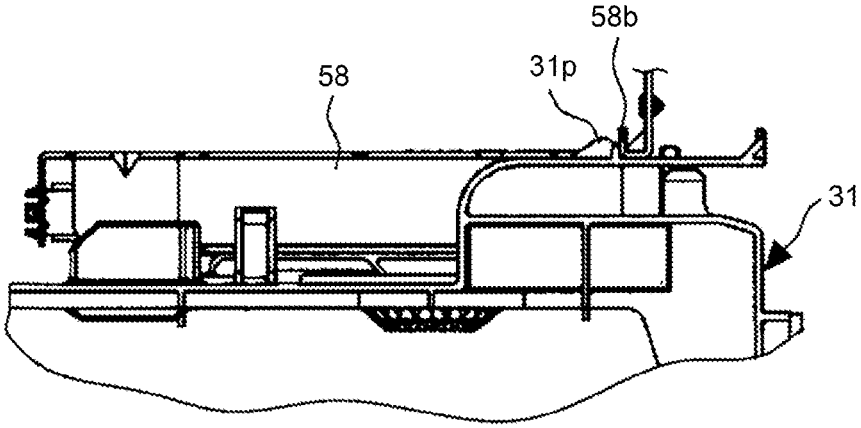

As illustrated in FIG. 8B, a bent portion 58*b* is formed in the bracket 58, to which the photosensor 57 is held, outside of the waste toner container 30 so as to abut thereon in a direction orthogonal to the attaching/detaching direction of the waste toner container 30 (vertical direction of the drawing in FIG. 3). Then, to the container main body 31 of the waste toner container 30, an abutment portion 31*p* (illustration is omitted in FIGS. 3 to 7C and the like) is formed so as to abut on the bent portion 58*b* of the above-described bracket 58 when the waste toner container 30 is installed in the image forming apparatus main body 1. Accordingly, temporary positioning relative to the image forming apparatus main body 1 when the waste toner container 30 is installed is accurately performed, whereby it is possible to improve the positional accuracy of the filler 55 relative to the photosensor 57.

Figure 8C:
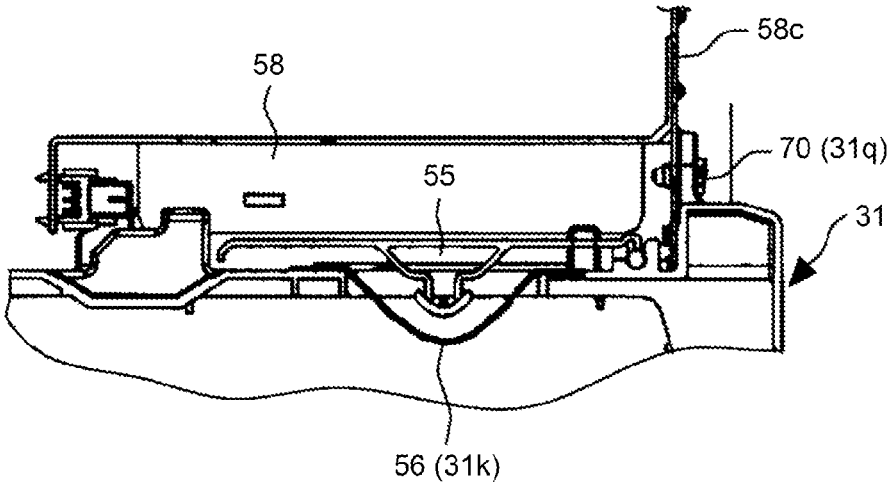

As illustrated in FIG. 8C, a bent portion 58*c* (female screw is formed) is formed in the bracket 58, to which the photosensor 57 is held, outside of the waste toner container 30 so as to abut thereon in the direction orthogonal to the attaching/detaching direction of the waste toner container 30 (vertical direction of the drawing in FIG. 3). Then, to the container main body 31 of the waste toner container 30, a positioning hole 31*q* (illustration thereof is omitted in FIGS. 3 to 7C and the like) is formed so as to correspond to a position of the female screw of the bent portion 58*c* of the above-described bracket 58 in a state where the waste toner container 30 is installed in the image forming apparatus main body 1. Then, a screw 70 is screwed with the female screw of the bent portion 58*c* through the positioning hole 31*q*, whereby the waste toner container 30 is fixed to the image forming apparatus 1 (bracket 58) by screw fastening. Accordingly, positioning relative to the image forming apparatus main body 1 when the waste toner container 30 is installed is accurately performed, whereby it is possible to improve the positional accuracy of the filler 55 relative to the photosensor 57.

Figure 9A:
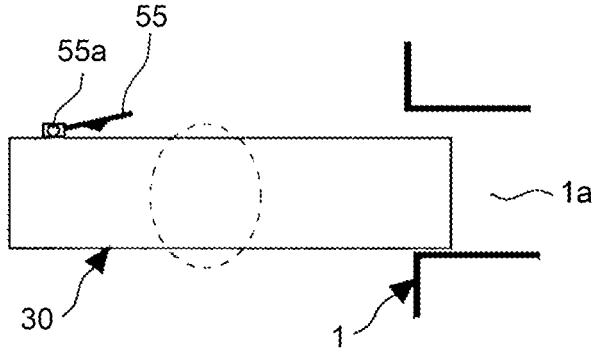
FIGS. 9A to 9D are schematic views illustrating a state in which the waste toner container is installed in the image forming apparatus main body in an attaching/detaching direction.
Figure 9B:
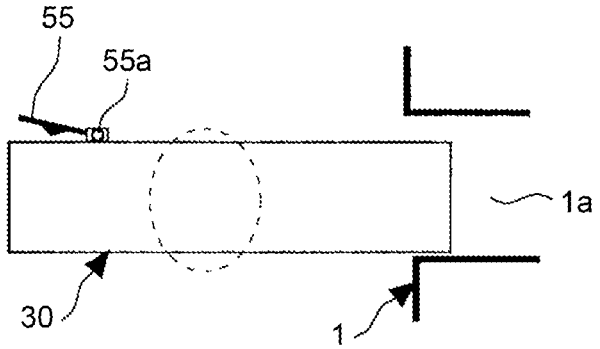

Here, in the first embodiment, as illustrated in FIG. 9A (or, see also FIG. 3 and the like), the filler 55 (movable member) is formed so as to extend in an attaching direction of the waste toner container 30 in the image forming apparatus main body 1 and is installed on a front side in the attaching direction of the waste toner container 30 (left side in FIGS. 9A to 9D). Also, in the filler 55, the spindle 55*a* (rotation center position) is arranged so as to position on an end portion of the front side in the attaching direction (left side in FIGS. 9A to 9D). When configured this way, when the filler 55 is in a lifted state as illustrated in FIG. 9A, when the waste toner container 30 is installed, it is likely that the filler 55 may interfere with an upper end and the like of an insertion opening portion 1*a* of the image forming apparatus main body 1. In contrast, as illustrated in FIG. 9B, in a case where the spindle 55*a* (rotation center position) is arranged in the filler 55 so as to position on an end portion on a deep side in the attaching direction (right side in FIGS. 9A to 9D), even if the filler 55 in the lifted state interferes with the upper end of the insertion opening portion 1*a*, the insertion opening portion 1*a* abuts on an inclined surface of the filler 55, whereby it is more likely that damage is avoided as a force in a direction for displacing the filler 55 downward acts on it and the filler 55 rotates centering on the spindle 55*a*. In this way, application of the present invention becomes particularly effective in the first embodiment in which the filler 55 is arranged as illustrated in FIG. 9A.

Figure 9C:
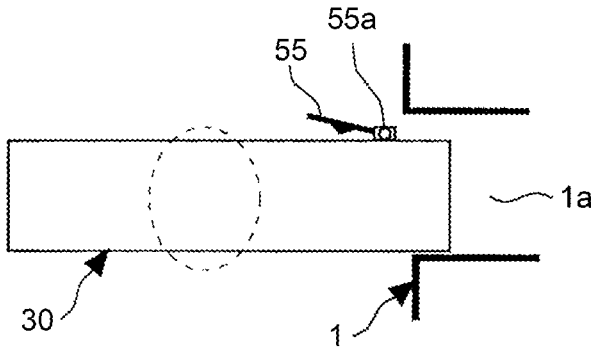
Figure 9D:
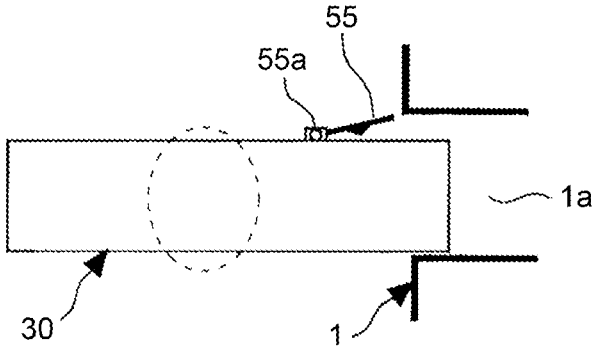

Note that in a case where the filler 55 is installed in the deep side in the attaching direction in the waste toner container 30 (right side in FIGS. 9A to 9D) as illustrated in FIGS. 9C and 9D, regardless of the position of the spindle 55*a*, the filler 55 is more likely to be lifted upward due to an installation operation by the operator compared to a case where the filler 55 is installed in the front side in the attaching direction as illustrated in FIGS. 9A and 9B.

Specifically, during the installation operation of the waste toner container 30, firstly, the operator engages the waste toner container 30 with the insertion opening portion 1*a* while gripping the central portion (a part surrounded by a dashed line) of the waste toner container 30 and pushes the waste toner container 30 toward the deep side in the attaching direction to some extent. At this time, as described above, the waste toner container 30 is slightly crushed due to the gripping force of the operator, whereby the inner pressure inside of the container is in the increased state, and the filler 55 is lifted upward together with the rubber sheet 56 due to the increased inner pressure. Subsequently, as it is pushed further into the deep side in the attaching direction, the operator releases a gripping hand, whereby final setting is completed by pushing the front side in the attaching direction of the waste toner container 30 in the attaching direction. In this way, in a case where the front side in the attaching direction of the waste toner container 30 is pushed, the waste toner container 30 is not in a crushed state, whereby lifting of the filler 55 hardly occurs. Therefore, in the case where the filler 55 is installed in the front side in the attaching direction as illustrated in FIGS. 9A and 9B, it is likely that the lifting of the filler 55 is decreased when the filler 55 reaches a position of the insertion opening portion 1*a*, whereas in the case where the filler 55 is installed in the deep side in the attaching direction as illustrated in FIGS. 9C and 9D, it is likely that the lifting of the filler 55 occurs when the filler 55 reaches the position of the insertion opening portion 1*a*. Therefore, as illustrated in FIGS. 9C and 9D, an effect of applying the present invention becomes even greater in the case where the filler 55 is installed in the deep side in the attaching direction (in particular, in the case where the spindle 55*a* is installed on the front side as in FIG. 9D).

As described above, the waste toner container 30 of the first embodiment is installed with the rubber sheet 56 (flexibility member) so as to cover the opening portion 31*k* formed on the ceiling portion 31*c*, the filler 55 (movable member) that is displaced by the push by the waste toner through the rubber sheet 56 and is detected by the photosensor 57 (detection means), and the regulating member 31*m* that limits the displacement of the filler 55. Accordingly, when the waste toner container 30 is attached to and detached from the image forming apparatus main body 1, it is possible to suppress the failure that the filler 55 of the waste toner detection unit 54 is displaced and contacts the image forming apparatus main body 1.

Note that in the waste toner container 30 of the first embodiment, the waste toner detection unit 54 is configured such that the filler 55 (movable member) and the rubber sheet 56 (flexibility member for covering the opening portion formed in the ceiling portion) are installed in the ceiling portion 31*c*; however, it is also possible to configure the waste toner detection unit 54 such that the filler 55 (movable member) and the rubber sheet 56 (flexibility member for covering the opening portion formed in a side wall) are installed in the side wall (the vertical wall portion 31*e*, the tip wall portion 31*f*, and the side wall portions 31*g* and 31*h*). Due to a configuration of positioning of the image forming apparatus main body 1 and the waste toner container 30, it is easier to set a gap between the image forming apparatus main body 1 and the waste toner container 30 to be smaller on the side than above, whereby by using the latter configuration, it is possible to decrease a distance for protruding the photosensor 57 from the side of the image forming apparatus main body 1 toward the side of the waste toner container 30.

Also in the first embodiment, it is configured such that the inflow port 31*a* is arranged on the one end side in the width direction and the waste toner detection unit 54 is arranged on the other end side in the width direction, and the conveyance screw 32 conveys the waste toner from the one end side in the width direction to the other end side in the width direction; however, application of the present invention is not to be limited to the waste toner container 30 configured this way.

The present invention is also applicable to the waste toner container 30 configured such that, for example, the inflow port 31*a* is arranged on each of the one end side in the width direction and the other end side in the width direction, the waste toner detection unit 54 is arranged in a central portion in the width direction, and the conveyance screw 32 conveys the waste toner from the both end portions in the width direction to the central portion in the width direction. In this case, the conveyance screw 32 is formed such that a winding direction of a screw unit wound from the one end side in the width direction to the central portion in the width direction and a winding direction of the screw unit wound from the other end side in the width direction toward the central portion in the width direction are opposite directions.

Also, in the first embodiment, the present invention is applied to the waste toner container 30 having the substantially trapezoidal shape when viewed from the side; however, application of the present invention is not to be limited to the waste toner container 30 having this shape.

Second Embodiment

In FIGS. 10 to 12C, a second embodiment of the present invention is described in detail.

Figure 10:
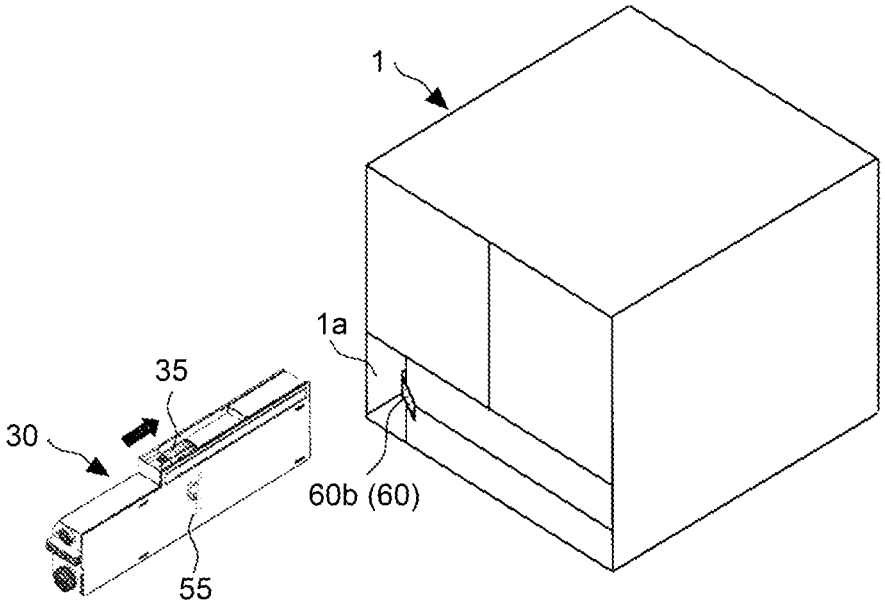
FIG. 10 is a perspective view illustrating a state in which a waste toner container according to a second embodiment of the present invention is installed in the image forming apparatus main body.
Figure 11:
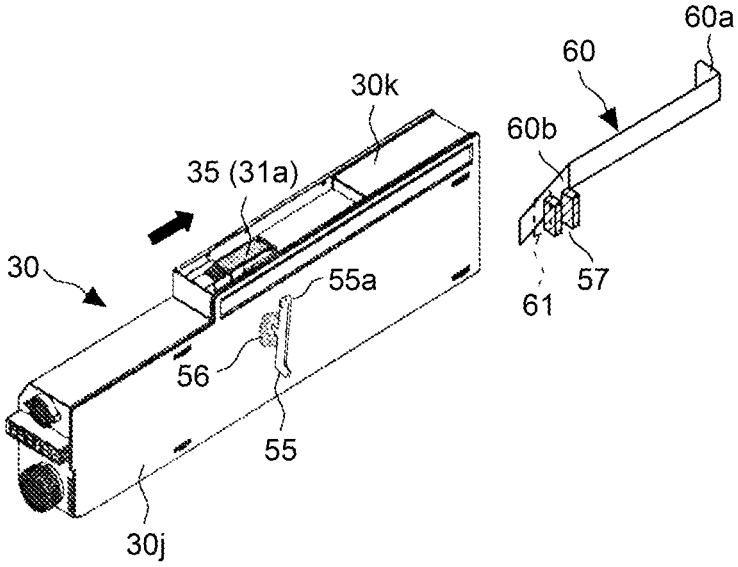
FIG. 11 is a perspective view illustrating a positional relationship between the waste toner container and a plate spring in FIG. 10.
Figure 12A:
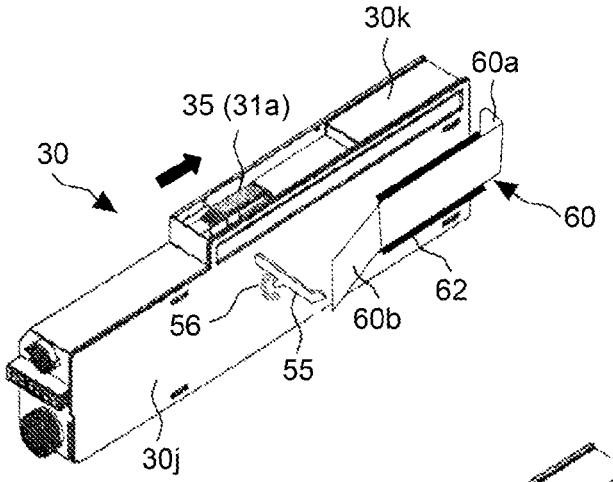
FIGS. 12A to 12C are perspective views illustrating a state in which the waste toner container in FIG. 11 is installed in the image forming apparatus main body.
Figure 12B:
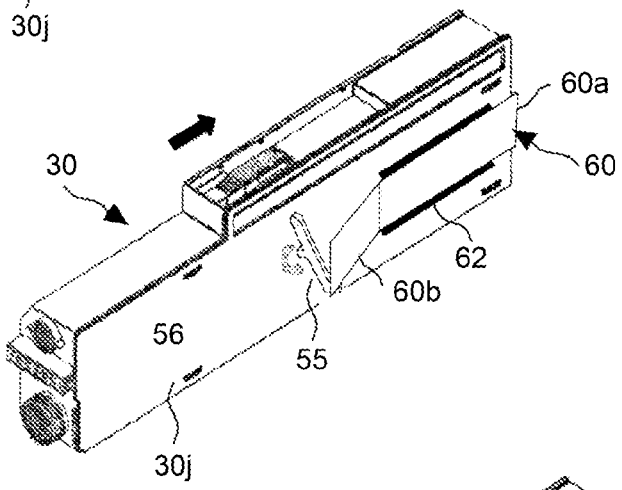
Figure 12C:
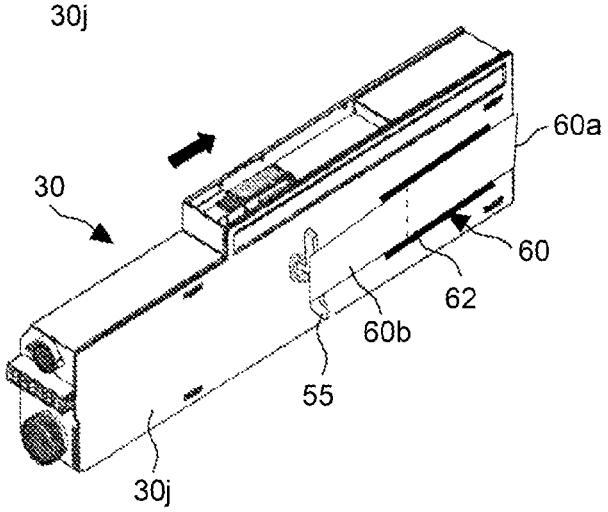

FIG. 10 is a perspective view illustrating a state in which a waste toner container 30 of the second embodiment is installed in an image forming apparatus main body 1, and FIG. 11 is a perspective view illustrating a positional relationship between the waste toner container 30 and a plate spring 60 (regulating member). FIGS. 12A to 12C are perspective views illustrating a state in which the waste toner container 30 in FIG. 11 is installed in the image forming apparatus main body 1.

The second embodiment is different from the first embodiment, in which the regulating member 31*m* is installed on the side of the waste toner container 30, in that the regulating member 60 (plate spring) is installed on the side of the image forming apparatus main body 1.

Although illustration is partly omitted, the waste toner container 30 of the second embodiment, similarly to that of the first embodiment, is constituted of a conveyance screw as a conveyance member, a waste toner detection unit constituted of a filler 55, a rubber sheet 56, and the like and that detects a full state (or a near-full state), a shutter 35 as an opening/closing member that opens and closes an inflow port 31*a* in link with attaching/detaching operation to and from the image forming apparatus main body 1, and the like.

Here, with reference to FIGS. 10, 11, and the like, the waste toner container 30 of the second embodiment, unlike that of the first embodiment, is formed to have a substantially rectangular parallelepiped shape. In the waste toner container 30, the waste toner detection unit constituted of the filler 55 (movable member) and the rubber sheet 56 (flexibility member for covering an opening portion formed in the side wall) is installed in a side wall 30*j*, not a ceiling portion 30*k*.

Then, as illustrated in FIGS. 10 and 11, when the waste toner container 30 is installed in the image forming apparatus main body 1 through an insertion opening portion 1*a*, the filler 55 is in a state of facing a photosensor 57 (detection means). Then, when the waste toner container 30 becomes the full state (or near-full state), the filler 55 is rotated centering on a spindle 55*a* (formed at an upper end in a vertical direction of the filler 55 and held by an unillustrated holding plate), whereby a tip portion thereof reaches a position that obstructs a detection position of the photosensor 57.

Here, in the second embodiment, unlike the first embodiment, the plate spring member 60 as the regulating member is installed in the image forming apparatus main body 1.

Specifically, with reference to FIG. 11 and the like, in the plate spring member 60 (regulating member), to a tip portion 60*b* corresponding to a front side in an attaching direction of the waste toner container 30, a bent portion is formed so as to bend in a direction away from the side wall 30*j*. A bending angle of the tip portion 60*b* relative to a base surface (surface substantially horizontal to the side wall 30*j*) is set to be 45 degrees or smaller (about 30 degrees in the second embodiment). The tip portion 60*b* is configured to move in a detaching direction when the waste toner container 30 is detached from the image forming apparatus main body 1 and to be exposed outside as illustrated in FIG. 10.

A bent portion is also formed in a rear end portion 60*a* corresponding to a deep side in the attaching direction of the waste toner container 30 so as to bend in a direction approaching the side wall 30*j*. A bending angle of the rear end portion 60*a* relative to the base surface (surface substantially horizontal to the side wall 30*j*) is set to be about 90 degrees. Although illustration is omitted, a magnet is stuck to a facing surface of the rear end portion 60*a* (surface facing a side wall on the deep side of the waste toner container 30), and corresponding to this, a metal plate is installed in the side wall on the deep side of the waste toner container 30.

Also, with reference to FIGS. 12A to 12C, the plate spring member 60 (regulating member) is configured to move in a predetermined moving range along a rail portion 62 of the image forming apparatus main body 1, extending in an attaching/detaching direction, in link with the attaching/detaching operation of the waste toner container 30 to and from the image forming apparatus main body 1.

Specifically, as illustrated in FIGS. 12A to 12C, the rail portion 62 is formed so as to extend in a predetermined length in the attaching/detaching direction denoted with a thick arrow so as to sandwich the plate spring member 60 in the vertical direction, and the plate spring member 60 is configured to be capable of sliding along the rail portion 62 in the attaching/detaching direction. The moving range of the plate spring member 60 is from a position where the waste toner container 30 is positioned within the apparatus main body 1 by the waste toner container 30 moving in the attaching direction (direction of a thick arrow) and pushing the rear end portion 60*a*, which is a limit position on the deep side in the attaching direction (position illustrated in FIG. 12C), and a position where the rear end portion 60*a* abuts on an end portion of the rail portion 62 by the plate spring member 60 moving in the detaching direction due to adsorption by the above-described magnet accompanying move of the waste toner container 30 in the detaching direction (opposite direction of the direction of the thick arrow), which is a limit position on the front side in the attaching direction (position illustrated in FIGS. 10 and 12A).

Then, the plate spring member 60 configured this way, in a case where the filler 55 (movable member) is in a state of being displaced to the side exceeding a position of the photosensor 57 (detection means) when the waste toner container 30 is installed in the image forming apparatus main body 1 (state in FIG. 12A), in link with installation operation of the waste toner container 30 to the image forming apparatus main body 1, first, the tip portion 60*b* (bent portion) contacts the filler 55 (in the state of being displaced to the side exceeding the position of the photosensor 57) as illustrated in FIG. 12B, and subsequently, the displacement of the filler 55 to the side exceeding the position of the photosensor 57 is limited by the bending angle of the tip portion 60*b* being deceased while the tip portion 60*b* (bent portion) is engaged with the rail portion 62 as illustrated in FIG. 12C.

More specifically, when the waste toner container 30 is installed in an image forming apparatus 1, even if the waste toner container 30 is slightly crushed due to a gripping force of an operator, and the inner pressure inside of the container is in an increased state, whereby the filler 55 is in a lifted state to the side together with the rubber sheet 56 due to the increased inner pressure as illustrated in FIG. 12A, by progressing with installation of the waste toner container 30, eventually the lifted filler 55 contacts the tip portion 60*b* of the plate spring member 60 as well as the rear end portion 60*a* of the plate spring member 60 contacts the container, whereby movement of the plate spring member 60 in the attaching direction is started.

Then, as illustrated in FIG. 12C, when installation of the waste toner container 30 is further progressed, in the plate spring member 60 moving along the rail portion 62 with the waste toner container 30, a bending shape of the tip portion 60*b* is elastically deformed along the rail portion 62 (angle relative to the side wall 30*j* is decreased and becomes closer to parallel). Then, accompanied by the deformation of the tip portion 60*b*, the filler 55, which has been pushed by the tip portion 60*b*, rotates centering on the spindle 55*a* up to a position not exceeding the position of the photosensor 57 (detection position). Accordingly, it is possible to prevent a failure that the filler 55 interferes with the photosensor 57 during the installation of the waste toner container 30. In particular, in the second embodiment, it is configured such that the tip portion 60*b* of the plate spring member 60 is exposed outside the apparatus main body 1 when the waste toner container 30 reaches the insertion opening portion 1*a* of the apparatus main body 1, whereby it is possible to also prevent a failure that the filler 55 interferes with the insertion opening portion 1*a*.

Note that for detaching the waste toner container 30 from the image forming apparatus main body 1, operation opposite of the above-described installation operation is performed.

Here, in the second embodiment, it is preferred that the filler 55 (movable member) be arranged to a position on a deeper side than a center position in the attaching direction of the waste toner container 30 to the image forming apparatus main body 1. By installing the filler 55 in the position closer to the deep side in the attaching direction this way, it is not necessary to set a length of the plate spring member 60 in the attaching direction to be very long, whereby it is possible to reduce a cost of parts of the plate spring member 60.

In the second embodiment, with reference to FIG. 11, it is preferred that a guide member 61 be installed between the photosensor 57 and the tip portion 60*b* of the plate spring member 60. Accordingly, when the plate spring member 60 is moved in the detaching direction accompanied by the detaching operation of the waste toner container 30 and the tip portion 60*b*, which has been elastically deformed as illustrated in FIG. 12C, is returned to an original bending shape, it is possible to suppress a failure that the tip portion 60*b* directly hits and damages the photosensor 57.

In the second embodiment, it is also preferred that the filler 55 be formed of a metal material. Accordingly, it is possible to suppress a failure that the filler 55 abuts on the plate spring member 60, whereby it is worn and deteriorated.

As described above, the waste toner container 30 of the second embodiment is installed with the rubber sheet 56 (flexibility member) so as to cover the opening portion formed in the side wall 30*j*, and the filler 55 (movable member) that is displaced by push by the waste toner through the rubber sheet 56 and is detected by the photosensor 57 (detection means). The image forming apparatus main body 1 is installed with the plate spring member 60 (regulating member) that limits the displacement of the filler 55. Accordingly, it is possible to suppress a failure that the filler 55 of a waste toner detection unit 54 is displaced when the waste toner container 30 is attached/detached to and from the image forming apparatus main body 1 and contacts the image forming apparatus main body 1.

Note that in each of the embodiments, process cartridges 10Y, 10M, 10C, and 10BK are configured to be integrally formed of each of the units of the image formation unit (a photoconductor drum 11, a charging unit 12, a developing unit 13, and a cleaning unit 15), whereby an image formation unit is made compact and maintenanceability is improved. In contrast, it is also possible to integrally form the waste toner container 30 with the process cartridge as a constituent member of the process cartridge. It is also possible to configure such that a part or all of the photoconductor drum 11, the charging unit 12, the developing unit 13, and the cleaning unit 15 are installed being replaceable alone in the apparatus main body 1, not as the constituent member of the process cartridge. Furthermore, the waste toner container 30 may also be configured such that the cleaning unit and a conveyance unit (conveyance pipe 16), which conveys the waste toner from the cleaning unit to the inflow port 31*a*, integrally as a unit. In this case as well, the same effect as that of each of the embodiments can be obtained.

In each of the embodiments, the present invention is applied to an image forming apparatus on which a developing unit 13 of a two-component developing system using a two-component developer is mounted; however, it is also possible to apply the present invention naturally to an image forming apparatus on which a developing unit 13 of a one-component developing system using a one-component developer is mounted.

Note that the "process cartridge" is defined as a unit installed in an attachable/detachable manner in the image forming apparatus main body, and is integrally formed of at least one of a charging unit that charges an image bearer, a developing unit (developing device) that develops a latent image formed on the image bearer, and the cleaning unit (cleaning device) that performs cleaning on the image bearer as well as the image bearer.

In each of the embodiments, the present invention is applied to the waste toner container 30 (color image forming apparatus 1) in which the waste toner recovered by the plurality of cleaning units 9 and 15 is flowed through the inflow port 31*a*. In contrast, it is also possible to apply the present invention naturally to a waste toner container in which the waste toner recovered by one cleaning unit is flowed through the inflow port (for example, a toner recovery container installed in a monochrome image forming apparatus). In this case as well, the same effect as that of each of the embodiments can be obtained.

In each of the embodiments, the present invention is applied to the waste toner container 30 configured such that the rubber sheet 56 (flexibility member) is deformed by a direct push by the waste toner, and the filler 55 (movable member) is displaced by the direct push by the waste toner through the rubber sheet 56. In contrast, it is also possible to apply the present invention naturally to the waste toner container 30 configured such that the rubber sheet 56 (flexibility member) is deformed by an indirect push by the waste toner through another member, and the filler 55 (movable member) is displaced by the indirect push by the waste toner through the other member and the rubber sheet 56.

Note that the present invention is not to be limited to each of the embodiments, and it is clear that each of the embodiments may be changed as appropriate within the scope of the technical idea of the present invention besides the changes suggested in each of the embodiments. The number, position, shape, and the like of the constituent members are not limited to those in each of the embodiments, and the number, position, shape, and the like suitable for carrying out the present invention may be used.

According to the present invention, it is possible to provide the waste toner container and the image forming apparatus in which, when the waste toner container is attached to and detached from the image forming apparatus main body, the failure that the movable member of the waste toner detection unit is displaced and contacts the image forming apparatus main body is not caused.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A waste toner container installed in an image forming apparatus main body, the waste toner container comprising:

a waste toner detector configured to detect a state in which a toner surface of the waste toner at that position is displaced up to a ceiling portion or near the ceiling portion, wherein the waste toner detector includes:

a flexibility member configured to cover an opening of the ceiling portion or a side wall of the waste toner container and to be deformed by a direct or indirect push by the waste toner; and a movable member configured to be displaced by the direct or indirect push by the waste toner interposing the flexibility member, and including an arm which contacts a regulating member to limit displacement of the moveable member.

2. The waste toner container according to claim 1, wherein the movable member is installed so as to project into a position above the ceiling portion or into a position to the side of the side wall.

3. The waste toner container according to claim 1, wherein the regulating member is formed so as to limit the displacement of the movable member to above or to side exceeding a position of the detector by contacting the movable member.

4. The waste toner container according to claim 1, wherein the regulating member is installed in the waste toner container.

5. The waste toner container according to claim 1, wherein the regulating member is installed in the image forming apparatus main body.

6. The waste toner container according to claim 5, wherein the regulating member is configured to move in a predetermined moving range along a rail portion of the image forming apparatus main body extending in attaching/detaching direction in link with an attaching/detaching operation of the waste toner container to and from the image forming apparatus main body, the regulating member is a plate spring member provided with a bent portion formed at a tip portion corresponding to a front side in the attaching direction of the waste toner container so as to bend in a direction away from the ceiling portion or the side wall, and in a case where the movable member is in a state of being displaced to above or to the side exceeding the position of the detector when the waste toner container is installed in the image forming apparatus main body, in link with the attaching operation of the waste toner container to the image forming apparatus main body, the bent portion contacts the movable member in a displaced state to above or to the side exceeding the position of the detector, and subsequently, by a bending angle of the bent portion being decreased while the bent portion is engaged with the rail portion, the displacement of the movable member to above or to the side exceeding the position of the detector is limited.

7. The waste toner container according to claim 1, wherein the regulating member is formed so as to contact the movable member between a rotation center position of the movable member and a position of the detector in the attaching/detaching direction of the waste toner container to and from the image forming apparatus main body.

8. The waste toner container according to claim 1, wherein the movable member is arranged to a position on a deeper side than a central position in the attaching direction of the waste toner container to the image forming apparatus main body.

9. The waste toner container according to claim 1, wherein the movable member is formed so as to extend in the attaching direction of the waste toner container to the image forming apparatus main body and such that the rotation center position thereof is arranged so as to position at an end portion on the deep side in the attaching direction.

10. The waste toner container according to claim 1, wherein the detector is installed in the image forming apparatus main body, and the waste toner container is formed to be positioned or temporarily positioned relative to the image forming apparatus main body at a position near the detector.

11. The waste toner container according to claim 1, further comprising:

an inflow port through which the waste toner discharged from the cleaning unit is flowed; and an opening and closing member configured to open and close the inflow port in link with the attaching/detaching operation to and from the image forming apparatus main body.

12. An image forming apparatus according to claim 1, wherein the waste toner container of claim 1 is installed in the image forming apparatus main body.

13. The waste toner container according to claim 1, wherein the regulating member is a hook-shaped projection.

14. The waste toner container according to claim 13, wherein the arm of the moveable member contacts the hook-shaped projection to limit an upward movement of the moveable member.

15. The waste toner container according to claim 1, wherein the regulating member is arranged to contact the moveable member between a rotation center position of the movable member and a position of the detector.

16. The waste toner container' according to claim 1, wherein the detector is fixedly installed in a holding member in the image forming apparatus main body.

17. The waste toner container according to claim 1, wherein the detector is a light emitting element and a light receiving element.

18. The waste toner container according to claim 17, wherein the moving member is interposed between the light emitting element and the light receiving element to block or not block the light.

19. The waste toner container according to claim 1, wherein the waste toner detector is arranged on a right-end side in a width direction and a front side in a depth direction.

20. The waste toner container according to claim 1, further comprising a shutter, wherein the shutter prevents the waste toner from leaking out of the waste toner container during attachment and detachment from the image forming apparatus main body.

* * * * *